US009097261B2

(12) United States Patent
Haaf

(10) Patent No.: US 9,097,261 B2
(45) Date of Patent: Aug. 4, 2015

(54) AXIAL FAN WITH FLOW GUIDE BODY

(75) Inventor: Oliver Haaf, Kupferzell (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 273 days.

(21) Appl. No.: 13/528,066

(22) Filed: Jun. 20, 2012

(65) Prior Publication Data

US 2013/0004349 A1 Jan. 3, 2013

(30) Foreign Application Priority Data

Jun. 29, 2011 (EP) ..... 11171974

(51) Int. Cl.
*F04D 29/32* (2006.01)
*F04D 29/54* (2006.01)

(52) U.S. Cl.
CPC ..... *F04D 29/329* (2013.01); *F04D 29/541* (2013.01); *F04D 29/547* (2013.01)

(58) Field of Classification Search
CPC ... F04D 29/545; F04D 29/547; F04D 29/541; F04D 29/542; F04D 29/544; F04D 29/329
USPC ..... 417/423.1, 423.14; 415/121.2, 208.2, 415/211.2, 220; 416/247 R
See application file for complete search history.

(56) References Cited

U.S. PATENT DOCUMENTS 915,178 A * 3/1909 Hillyard ..... 415/8
1,502,862 A * 7/1924 Menk ..... 417/423.15
2,228,116 A 1/1941 Igl et al.
3,347,452 A 10/1967 Radcliffe
4,712,977 A * 12/1987 Gerfast ..... 415/208.2
6,213,718 B1 * 4/2001 Hill et al. ..... 416/146 R
7,530,783 B1 * 5/2009 Ediger ..... 415/121.2
2006/0228212 A1 * 10/2006 Sadi ..... 415/206
2007/0065281 A1 3/2007 Lan et al.
2007/0154308 A1 7/2007 Yang
2009/0269195 A1 * 10/2009 Hsu et al. ..... 415/208.2

FOREIGN PATENT DOCUMENTS

DE 10 2005 055 264 A1 5/2007
EP 0 185 948 7/1986

OTHER PUBLICATIONS

European Search Report—Dec. 16, 2011.

* cited by examiner

*Primary Examiner* — Charles Freay
*Assistant Examiner* — Kenneth J Hansen
(74) *Attorney, Agent, or Firm* — Brinks Gilson & Lione

(57) ABSTRACT

An axial fan (1) having a motor comprising a stator (2) and a rotor (3), wherein blades (4), which move a gaseous medium in an axially directed main flow direction (S) from an inlet side (E) to an outlet side (A) of the fan, project from the outer periphery (U3) of the rotor (3). For enhanced performance with regard to efficiency in a structurally less costly manner, a rotation-symmetric flow guiding element (5) is mounted on the outlet side (A) directly or indirectly on the stator (2) and concentrically with respect to a stator hub (2*a*). The flow guiding element to have an outer diameter (D5) that is greater than the outer diameter (D2) of the stator hub (2*a*) greater than the outer diameter (D3) of the rotor (3), and smaller than the diameter (D4) of a perimeter (U4) around the blades (4).

11 Claims, 4 Drawing Sheets

AXIAL FAN WITH FLOW GUIDE BODY

CROSS REFERENCE TO RELATED APPLICATIONS

This application claims priority to European patent application number 11171974.6, filed Jun. 29, 2011.

FIELD OF THE INVENTION

The invention concerns an axial fan having a motor comprising a stator and a rotor, wherein blades, which move a gaseous medium in an axially directed main flow direction from an inlet side to an outlet side, project from the outer periphery of the rotor, which is configured as fan wheel.

BACKGROUND AND SUMMARY OF THE INVENTION

With fans of the above-referenced type, of which many embodiments are known, one constant development objective is to maximize the attainable efficiency. Efficiency is understood in the narrower sense-only with reference to the fan wheel-to be the ratio of the flow rate of the fan to the power requirement of the fan shaft. For a given shaft power, the efficiency is determined from the conveyed gas volume flow and the total pressure increase produced by the fan. The product of these gives the flow rate, with total pressure being understood according to the so-called Bernoulli equation as the sum of static and dynamic pressure.

This development objective, wherein each percentage point of efficiency increase is important, has gained in relevance in connection with the new formulation of the so-called Ecodesign Directive or ErP Directive (Directive 2009/125/EG of the European Union), which comprises not only energy-using products, but generally energy-related products for the minimization of harmful environmental pollution. This applies both to fans operated as stand-alone devices and to fans that are integrated as components of a device or system. The ErP Directive thereby specifies minimum efficiencies, whereby here efficiency of the entire fan, that is, the unit consisting of the control electronics (if present), motor, and fan wheel is assessed as efficiency in the broader sense.

It is the object of the invention to create an axial fan of the kind described previously, by which improvements of operating performance with regard to efficiency can be attained in a less costly manner. The noise level should not be affected by this, but preferably would be improved.

This object is attained according to the invention by mounting a rotation-symmetric flow guiding element on the outlet side directly or indirectly on the stator and concentrically with respect to a stator hub. Said flow guiding element has an outer diameter that is greater than the outer diameter of the stator hub, greater than the outer diameter of the rotor, and smaller than the diameter of a perimeter around the blades. Such a flow guiding element provided according to the invention, which is mounted in the direction of flow behind the fan, acts advantageously as a blockage or deflector plate for the conveyed gas flow, and prevents a volume flow from being drawn from a region of turbulence behind the motor. Such turbulence zones, which are produced after a stream separates from a body around which it has been flowing, are also called "dead water zones" or "eddy flow regions" in the case where a liquid is the flow medium. There is no laminar flow there.

In addition, the flow guiding element provided according to the invention also ensures that a backflow of flow medium can only begin within a diameter range that is greater than the diameter of the hub, thus restricting backflow. This occurs, in turn, because the backflow must take place against centrifugal force, which increases proportionally with the distance to the fan axis. A backflow zone that arises in particular when using axial fans with high counterpressure can be kept comparatively low according to the invention. Because the flow through the fan separates only when the diameter is greater than the diameter of the hub, up to the time of its separation it can also reach a comparatively higher pressure than when the flow guiding element is not present. The total attainable pressure increase with the fan thereby rises, and the efficiency increases by a few percentage points in comparison with a fan without such a flow guiding element.

The flow guiding element provided according to the invention can be advantageously used together with a protective screen likewise mounted at the outlet side on the stator of the axial fan. At the same time, it can be configured as a separate component or can be integrated into the protective screen, that is to say, mounted in particular thereon or therein. A one-piece configuration with the protective screen is also possible in this regard.

The flow guiding element can be advantageously mounted as a plastic or metal part that may be clipped on, screwed in, riveted, or welded, that is, it can be friction-fitted, form-fitted and/or bonded, in particular in a manner that is less costly from the point of view of production and assembly as a plastic part that can be clipped on or can be configured as a weldable metal part with higher strength in a more robust design.

In a preferred embodiment, the flow guiding element can be configured in a conical shape, in particular with the basic shape of a truncated cone, wherein, when mounted, its jacket surface diverges in a direction facing away from the stator. This has the advantageous effect that the slanted position of the jacket surface causes the flow to be deflected outward and that the flow guiding element thus acquires a better guiding capacity.

Other advantageous embodiments of the invention are contained in the following description.

BRIEF DESCRIPTION OF THE DRAWINGS

The invention will be described in further detail with reference to several exemplary embodiments, which are depicted in the enclosed drawings, wherein.

DETAILED DESCRIPTION OF THE INVENTION

With regard to the following description, it is expressly emphasized that the invention is not limited to the exemplary embodiments nor to all or several features of the described feature combinations, but rather each individual partial feature of each exemplary embodiment can also have inventive importance per se, as well as in combination with any other features of another exemplary embodiment separately from the other partial features described in connection therewith.

Figure 1:
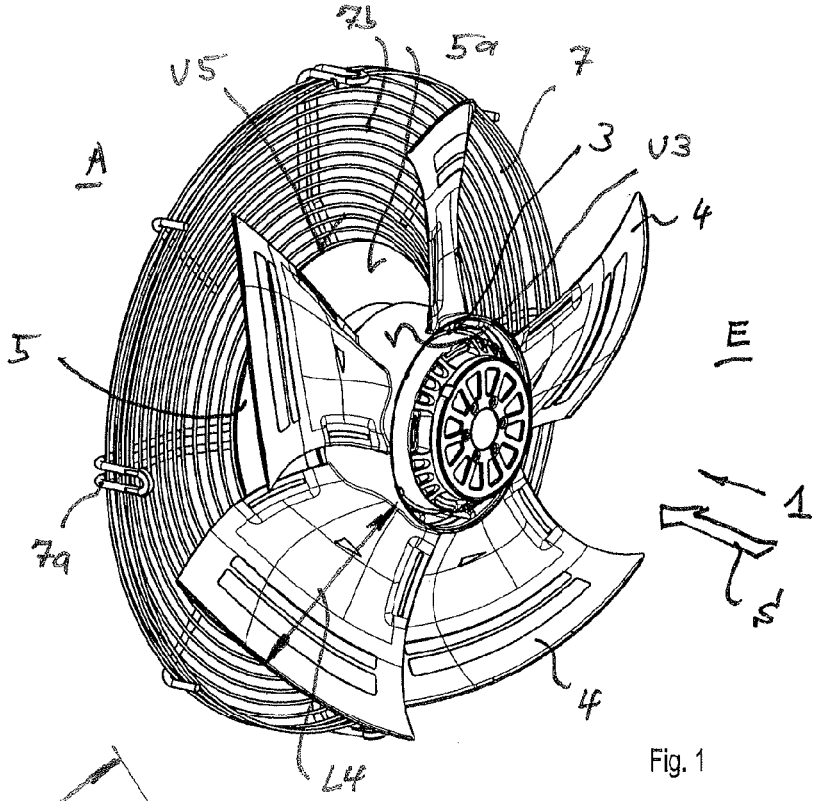
FIG. 1 shows a perspective view of a first embodiment of an axial fan according to the invention seen from the inlet side of the flow medium.
Figure 3:
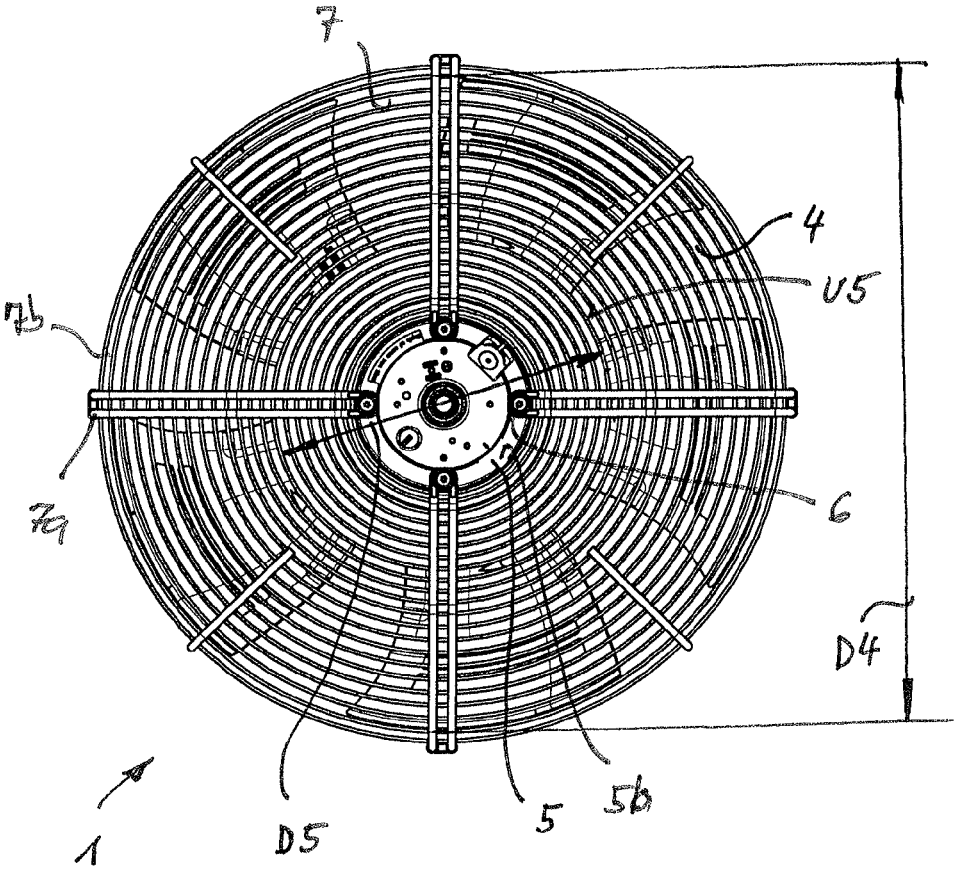
FIG. 3 shows a top view of the embodiment of the axial fan according to the invention represented in FIG. 1 seen from the outlet side of the flow medium.
Figure 4:
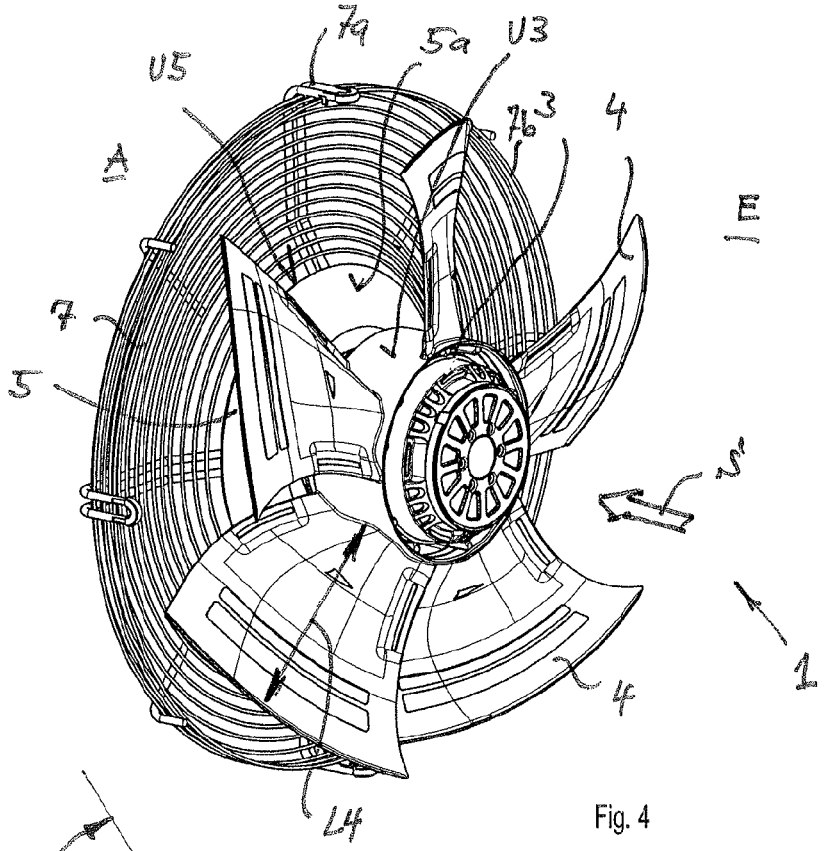
FIG. 4 shows a perspective view of a second embodiment of an axial fan according to the invention seen from the outlet side of the flow medium.

The same parts are also always provided with the same reference signs in the figures of the drawings, so that as a rule they are only described once. As emerges initially from the representation in FIGS. 1 to 3 of the first embodiment of the invention, but also from FIGS. 4 to 6 of the second embodiment of the invention, a fan 1 according to the invention, which—as shown—is configured in axial design, comprises a stator 2 and a rotor 3, wherein blades 4, which move a gaseous medium in an axially directed main flow direction S from an inlet side E toward an outlet side A, are mounted on the outer periphery U3 of the rotor 3 configured as a fan wheel having an outer diameter D3. The tips of the blades 4 move over a perimeter U4 having a diameter D4, which can be considered as the maximum diameter of the fan wheel.

It is provided according to the invention that a rotationally-symmetric flow guiding element 5 having an outer diameter D5, which is greater than the outer diameter D2 of the stator hub 2*a* and greater than the outer diameter D3 of the rotor 3, is mounted at the outlet side A indirectly or directly on the stator 2 and concentrically with respect to a stator hub 2*a*. Its maximum possible size is theoretically limited by the diameter D4 of the perimeter U4 around the blades 4, wherein, however, the outer diameter D5 of the flow guiding element 5 should be at least 15% smaller than the diameter D4 of the perimeter U4, so that a conveying flow goes in the axially directed main flow direction S.

The advantages associated with the invention were already presented previously. It is particularly evident that the flow through the axial fan 1 can reach a higher pressure at the outer diameter D5 of the flow guiding element 5, where it separates, than at the outer diameter D2 of the stator hub 2*a*, whereby a higher efficiency is attained.

The flow guiding element 5 can be configured as a plastic or metal part that can be clipped, screwed, riveted or welded on. Element 5 formed as a plastic part can be clipped on or a metal part that can be welded on. In the two illustrated modifications, the flow guiding element 5 is screwed to the stator 2, in particular to its stator hub 2*a*, by means of the screws 6.

The outer diameter D5 of the flow guiding element 5 is preferably dimensioned in such a way that the outer periphery U5 of the flow guiding element 5 runs over a radius $R_{opt}$, which is separated from the outer periphery U3 of the rotor 3 by a distance of a maximum of 40% of the length L4 of the blades 4, and runs preferably within an area that is separated from the outer periphery U3 of the rotor 3 by a distance of about 20% to 30% of the length L4 of the blades 4. Since the blades 4 can have different configurations—for example, with an end and/or with a curved outer edge—a value obtained according to the formula (1) is considered the definitive length L4 of the blades 4:

$$L4=(D4-D3)/2 \quad (1)$$

Hence the above-mentioned optimal ratio range can also be expressed by means of the following formula (2) or more specifically the simple formula (3)

$$D5/2=R_{opt}=D3/2+(0.2\ldots0.3)*(D4-D3)/2 \quad (2)$$

$$D5=D3+(0.2\ldots0.3)*(D4-D3) \quad (3)$$

The optimal limit value condition for the outer diameter D5 of the flow guiding element 5 consequently reads:

$$D5<D3+0.4*(D4-D3) \quad (4)$$

Here the greatest diameter value D3 is used for the calculation in the case of a conical configuration of the outer periphery U3 of the rotor 3.

Figure 2:
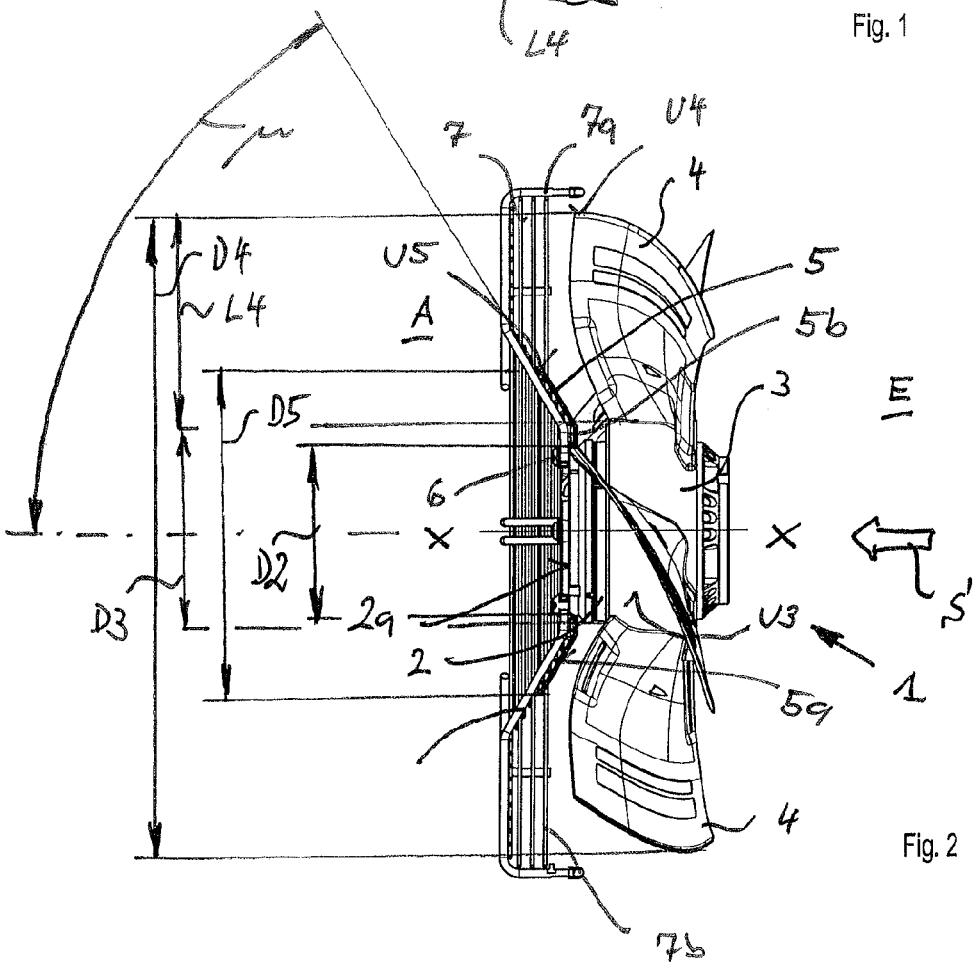
FIG. 2 shows a lateral view of the embodiment of an axial fan according to the invention represented in FIG. 1.
Figure 5:
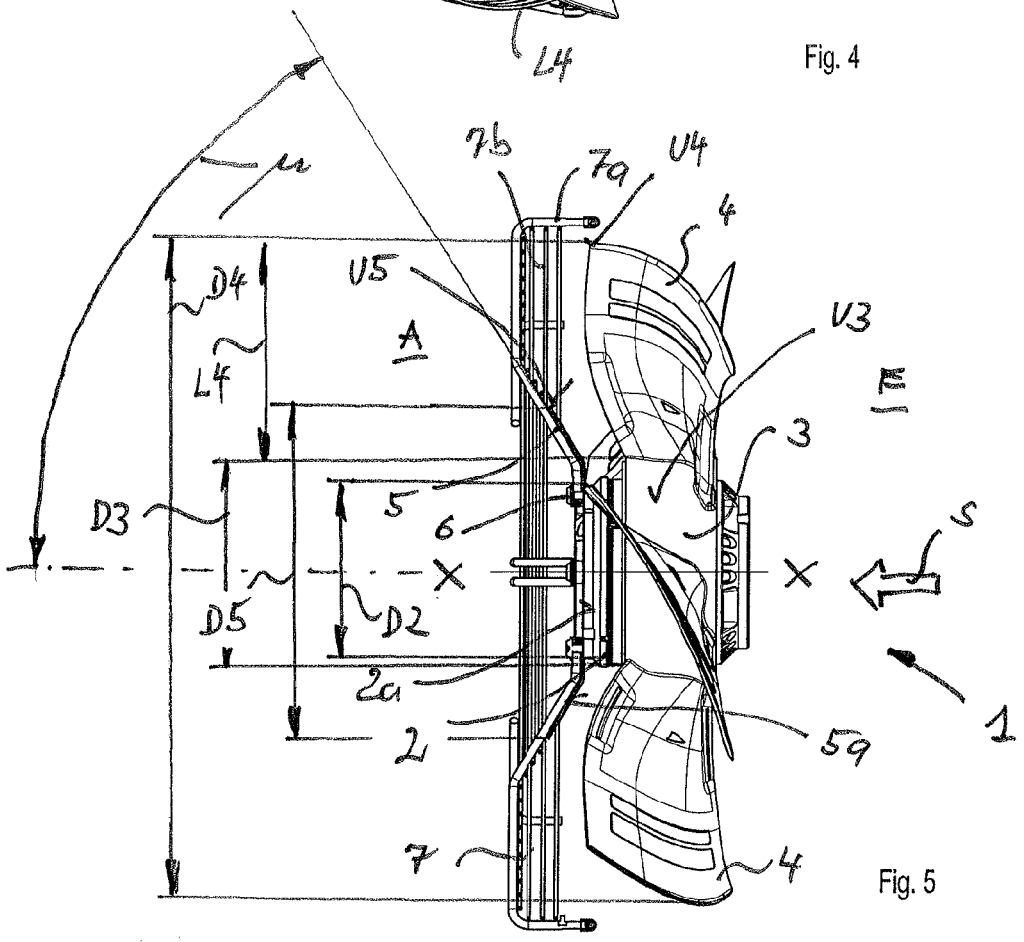
FIG. 5 shows a lateral view of the embodiment of an axial fan according to the invention represented in FIG. 4.
Figure 6:
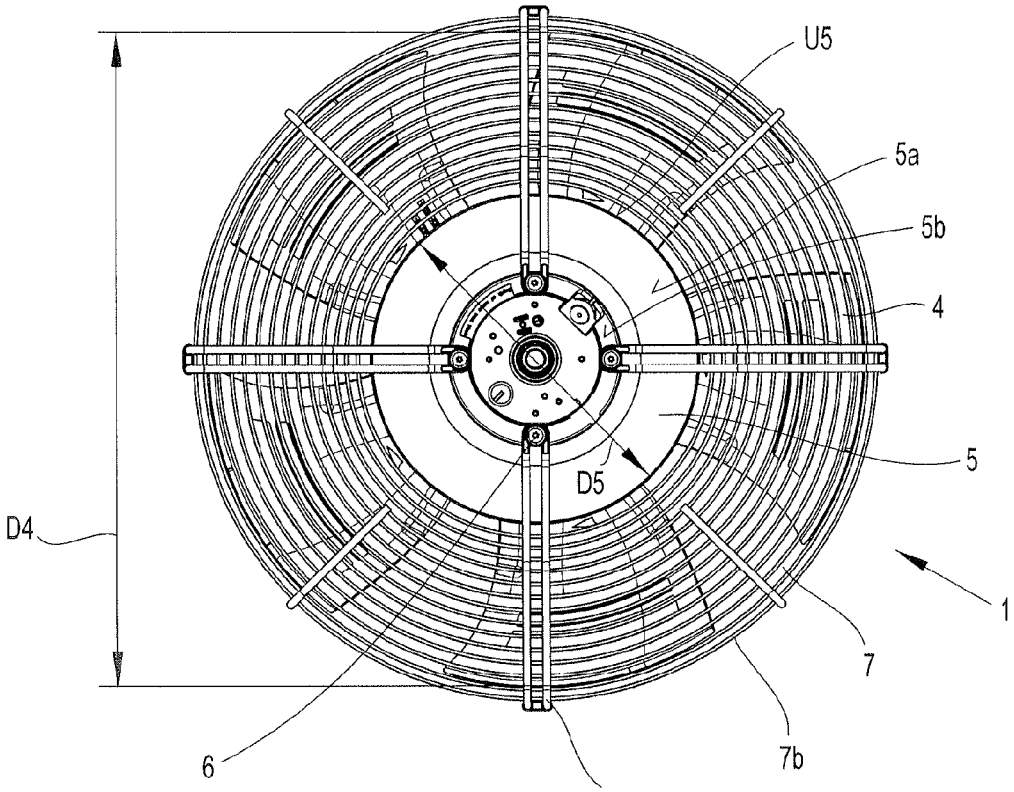
FIG. 6 shows a top view of the embodiment of an axial fan according to the invention represented in FIG. 4 from the outlet side of the flow medium.

The corresponding diameter and length ratios are very well illustrated in particular by means of FIGS. 2 and 5. The greatest efficiency increases may be obtained in this ratio range.

For the purpose of obtaining better conduction of the flow, flow deflection can be effected by the slanted position of the inflow surface of the flow guiding element 5 formed by the jacket 5*a*. For this purpose, in accordance with the invention, as shown it can preferably be provided that the flow guiding element 5 can be configured with a basic conical, and preferably a truncated conical shape, wherein its jacket surface 5*a* diverges in the direction facing away from the stator 2 when assembled. As FIGS. 2 and 5 in particular illustrate, here it can be especially preferably provided that the jacket surface 5*a* of the flow guiding element 5 runs at an angle μ with respect to the longitudinal axis X-X of the fan, which is no less than 30° and is preferably within the range of 55° to 65°. The greatest efficiency increases are recorded within this angular range.

The two represented embodiments of the invention show that a protective screen 7 is mounted on the outlet side A on the stator 2. The second embodiment shown in FIGS. 4 to 6 differs from the first embodiment of FIGS. 1 to 3 in that the flow guiding element 5 is integrated into the protective screen 7. In both embodiments the flow guiding element 5 and the protective screen 7 with the stator hub 2*a* are affixed by means of the screws 6. The screws 6 pass simultaneously through mounting openings in radial mounting struts 7*a* for the protective screen 7 or for its screen struts 7*b*, which are concentric with respect to the periphery, as well as mounting openings in the edge 5*b* of the flow guiding element 5, which are vertical with respect to the axially directed main flow direction S.

The integration of the flow guiding element 5 in the protective screen 7 present in the second embodiment means that the screen struts 7*b* of the protective screen 7, which are concentric with respect to the periphery, are recessed in an advantageous, material-saving way within the area of the flow guiding element 5. The jacket 5*a* of the flow guiding element 5 adapts to the shape of the protective screen 7 and advantageously assumes part of its protective function.

The first embodiment shows, instead, that in order to increase the efficiency of a fan in accordance with the invention, it is not necessary to provide new blading at the rotor 3, but rather that the flow guiding element 5 provided according to the invention can be used with fan components that are known per se. In other words: there is no need to define new types of fans in order to increase the efficiency; the existing fans can be retrofitted with a flow guiding element 5 according to the invention. The noise level is not worsened by this, but rather even an improvement could be observed.

An axial fan 1 according to the invention can preferably be provided with free exhaust, for example, for assembly in a housing wall or in a device or machine, thus without a pipe or duct system connected downstream, since the flow guiding element 5 develops its highest efficiency in this case because of the self-adjusting general flow conditions. As can already be seen from the previous modifications, the invention is not limited to the represented exemplary embodiments, but encompasses all equivalent means and measures in the sense of the invention. Thus it is also within the scope of the invention if the geometric shape of the axial fan 1 deviates from that shown, or if instead of or in addition to the protective screen 7, there is a spider for a "stand-alone" configuration of the axial fan according to the invention. The flow guiding element 5 can be mounted—as shown—directly or indirectly on the stator 2, for example via the protective screen 7, without abandoning the scope of the invention.

Figure 7:
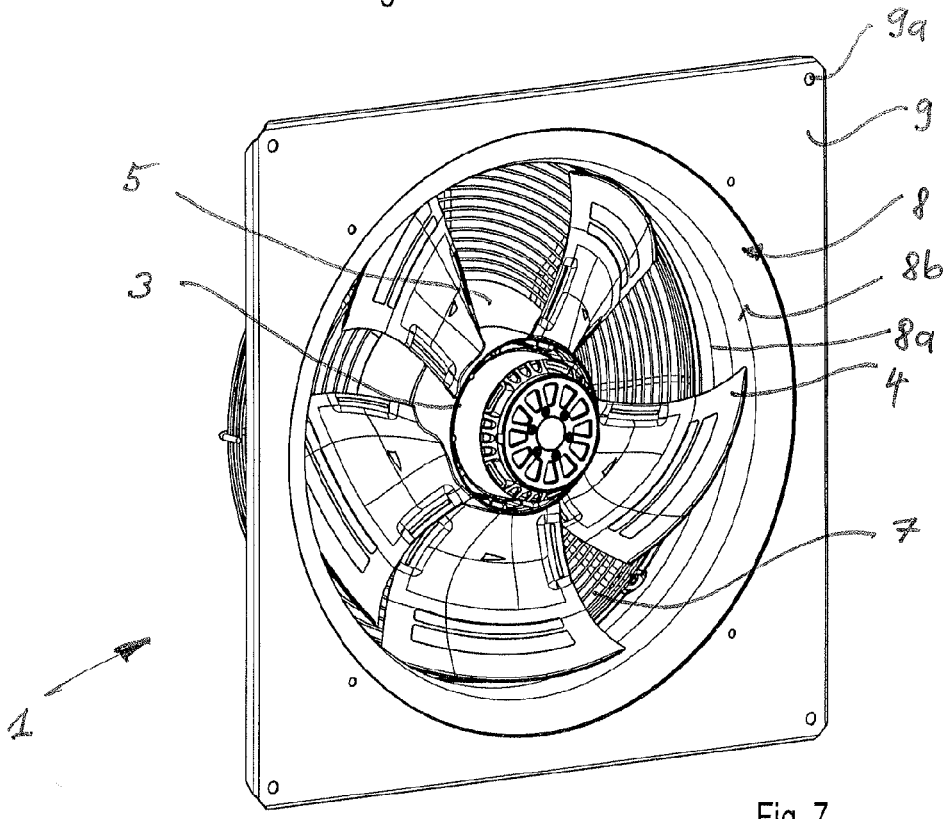
FIG. 7 shows another embodiment of an axial fan according to the invention in a representation similar to that of FIGS. 1 and 4.

The person skilled in the art can furthermore provide additional practical technical measures without abandoning the scope of the invention. Thus, FIG. 7 shows an embodiment of an axial fan 1 according to the invention, in which the blades 4 are enclosed on the outside by a guide nozzle, which is configured as a cone in the main flow direction S, and then in the further course is configured as a hollow cylinder. Such a nozzle 8 can be configured with a different axial length depending on the installation situation, for example, as a so-called short nozzle, in which the blades 4 project from the nozzle channel 8*a* at the outlet side A. Among other things this prevents flow guided through the flow guiding element 5 from striking the nozzle wall 8*b*, which under certain conditions could lead to losses in efficiency. Interacting synergistically with the flow guiding element 5, the nozzle 8 optimizes the flow pattern in the fan 1 according to the invention. In the same embodiment, the round guide nozzle 8 is appropriately embedded in a frame structure, in particular a square frame structure, which encloses it on all sides and features mounting openings 9*a* for assembly.

While the above description constitutes the preferred embodiment of the present invention, it will be appreciated that the invention is susceptible to modification, variation and change without departing from the proper scope and fair meaning of the accompanying claims.

The invention claimed is:

1. An axial fan (1) comprising a motor with a stator (2) and a rotor (3), a plurality of blades (4), which move a gaseous medium in an axially directed main flow direction (S) from an inlet side (E) to an outlet side (A) of the fan, projecting from an outer periphery (U3) of the rotor (3), which is configured as a fan wheel, one rotation-symmetric flow guiding element (5), the flow-guiding element (5) having an outer diameter (D5) that is greater than an outer diameter (D2) of a stator hub (2*a*) of the stator, and greater than an outer diameter (D3) of the rotor (3), and smaller than an diameter (D4) of a perimeter (U4) of the blades, the guiding element (5) mounted on the outlet side (A) on the stator (2) downstream of the stator and has a slanted jacket surface without any axial overlap with the stator including the stator hub, the slanted jacket being arranged concentrically with respect to the stator hub (2*a*), wherein the outer diameter (D5) of the flow guiding element (5) is dimensioned in accordance with the formula D5<D3+0.4*(D4−D3), the flow guiding element (5) being a separate part axially affixed to an axial end of the stator hub (2*a*), and a protective screen, wherein the flow guiding element (5) has a mounting edge with mounting openings concentric with mounting openings on an inner periphery of the protective screen for simultaneous attachment of the flow guiding element (5) and of the protective screen to the axial end of the stator hub (2*a*).

2. The fan (1) of claim 1, wherein the flow guiding element (5) is integrated into the protective screen.

3. The fan (1) of claim 1 further comprising that the flow guiding element (5) is configured as a plastic or metal part that is screwed or riveted on.

4. The fan (1) of claim 1 wherein the outer diameter (D5) of the flow guiding element (5) is dimensioned in accordance with the formula D5=D3+x*(D4−D3), wherein x is in a range of 0.2 through 0.3.

5. The fan (1) of claim 1, wherein the flow guiding element is configured in basic conical shape, wherein a jacket surface (5*a*) of the flow guiding element extends from the stator without any axial overlap with the stator in an axial direction facing away from the stator (2) and from the rotor (3) and radially diverges along the axial direction facing away from the stator (2) and from the rotor (3) when assembled.

6. The fan (1) of claim 5 wherein the flow guiding element (5) is in the shape of a truncated cone.

7. The fan (1) of claim 5, wherein the jacket surface (5*a*) of the flow guiding element (5) runs at an angle (μ) with respect to a longitudinal axis of the fan, which is no less than 30°.

8. The fan (1) of claim 5 wherein the jacket surface (5*a*) of the flow guiding element (5) runs at an angle (μ) within the range of 55° to 65°.

9. The fan (1) of claim 1 wherein that the blades (4) are enclosed on the outside by a guide nozzle (8) that is conical in the main flow direction (S).

10. The fan (1) of claim 9 wherein the guide nozzle (8) further has a hollow cylindrical shape.

11. The fan (1) of claim 5, wherein the mounting edge is ring-shaped and radially overlaps with the stator hub.

* * * * *